US010458599B2

(12) United States Patent
Baune et al.

(10) Patent No.: US 10,458,599 B2
(45) Date of Patent: Oct. 29, 2019

(54) STORAGE BOX FOR BOTTLES OF PRESSURIZED FLUID AND ASSOCIATED STORAGE FRAME

(71) Applicants: L'Air Liquide, Société Anonyme pour l'Etude et l'Exploitation des Procédés Georges Claude, Paris (FR); Air Liquide Oil and Gas Services Limited, Coleshill (GB)

(72) Inventors: Emmanuel Baune, Igny (FR); Guillaume Arnaud, Paris (FR); Paul Burgin, Mansfield (GB); Steve Robertson, Aberdeen (GB); Nils Aksnes, Glasgow (GB); Tom Blakeman, Glasgow (GB)

(73) Assignees: L'Air Liquide, Société Anonyme pour l'Etude et l'Exploitation des Procédés Georges Claude, Paris (FR); Air Liquide Oil & Gas Services Limited, West Midlands (GB)

( * ) Notice: Subject to any disclaimer, the term of this patent is extended or adjusted under 35 U.S.C. 154(b) by 0 days.

(21) Appl. No.: 15/757,069

(22) PCT Filed: Aug. 2, 2016

(86) PCT No.: PCT/FR2016/052004
§ 371 (c)(1),
(2) Date: Mar. 2, 2018

(87) PCT Pub. No.: WO2017/037357
PCT Pub. Date: Mar. 9, 2017

(65) Prior Publication Data

US 2018/0172214 A1 Jun. 21, 2018

(30) Foreign Application Priority Data

Sep. 4, 2015 (FR) ..... 15 58242

(51) Int. Cl.
*F17C 13/08* (2006.01)

(52) U.S. Cl.
CPC .... *F17C 13/084* (2013.01); *F17C 2201/0109* (2013.01); *F17C 2201/032* (2013.01);
(Continued)

(58) Field of Classification Search
CPC ..... F17C 13/084; F17C 2201/0109; F17C 2201/032; F17C 2201/035;
(Continued)

(56) References Cited

U.S. PATENT DOCUMENTS 2,011,347 A 8/1935 Ragonnet
2,288,622 A * 7/1942 Heigis ..... A47B 81/007 211/75
(Continued)

FOREIGN PATENT DOCUMENTS

DE 3026495 A1 * 1/1982 ..... B65D 19/38
DE 38 05 497 4/1989
(Continued)

OTHER PUBLICATIONS

French Search Report for corresponding FR 1558242, dated Jun. 22, 2016.
(Continued)

*Primary Examiner* — Stanton L Krycinski
(74) *Attorney, Agent, or Firm* — Elwood L. Haynes

(57) ABSTRACT

A storage frame for cylinders of pressurized fluid, including a primary structure and at least one storage box including at least one cylinder of pressurized fluid extending along a longitudinal axis between two ends, having at least one first retaining member configured to collaborate fixedly with one end of the at least one cylinder and blocking the rotation of
(Continued)

the cylinder, and at least one second retaining member configured to collaborate with the other end of the cylinder.

16 Claims, 9 Drawing Sheets

(52) U.S. Cl.
CPC .. *F17C 2201/035* (2013.01); *F17C 2201/056* (2013.01); *F17C 2203/0663* (2013.01); *F17C 2205/013* (2013.01); *F17C 2205/0107* (2013.01); *F17C 2205/0111* (2013.01); *F17C 2205/0142* (2013.01); *F17C 2205/0157* (2013.01); *F17C 2205/0188* (2013.01); *F17C 2223/0123* (2013.01); *F17C 2223/035* (2013.01); *F17C 2260/015* (2013.01); *F17C 2270/0745* (2013.01)

(58) Field of Classification Search
CPC ..... F17C 2201/056; F17C 2203/0663; F17C 2205/0107; F17C 2205/0111; F17C 2205/013; F17C 2205/0142; F17C 2205/0157; F17C 2205/0188; F17C 2223/0123; F17C 2223/035; F17C 2260/015; F17C 2270/0745
See application file for complete search history.

(56) References Cited

U.S. PATENT DOCUMENTS 3,065,857 A * 11/1962 Sanders ..... F17C 13/084 211/85.19
3,602,368 A * 8/1971 Gould ..... F17C 13/084 108/55.1
3,791,403 A * 2/1974 Folkerth ..... F17C 13/084 128/204.18
4,295,431 A * 10/1981 Stavlo ..... B65D 19/08 108/55.1
4,481,972 A * 11/1984 Stavlo ..... B65D 19/08 108/55.1
4,564,109 A * 1/1986 Stavlo ..... B65D 19/08 206/391
4,899,968 A * 2/1990 Eaglin ..... A47F 5/02 211/78
5,040,993 A 8/1991 Lee et al.
5,074,421 A * 12/1991 Coulter ..... A47F 5/02 211/163
5,176,265 A * 1/1993 Bennett ..... A47F 7/28 108/55.5
5,385,263 A * 1/1995 Kirk ..... F17C 1/16 206/443
5,542,576 A * 8/1996 Arment ..... B65D 45/02 220/323
6,059,127 A * 5/2000 Bennett ..... B62B 3/02 211/85.18
6,196,255 B1 * 3/2001 Poillucci ..... F17C 13/084 137/266
6,536,722 B2 * 3/2003 Sadowski ..... F17C 13/084 248/154
6,708,719 B2 * 3/2004 Idoguchi ..... F17C 1/00 137/266
6,786,229 B1 * 9/2004 Friedlmeier ..... F17C 1/00 137/259
6,786,245 B1 * 9/2004 Eichelberger ..... B60S 5/02 141/18
7,017,741 B1 * 3/2006 Williamson ..... F17C 13/084 206/386
7,137,474 B2 * 11/2006 Yokote ..... F17C 13/084 180/314
7,275,902 B1 * 10/2007 Klotz ..... B60P 3/055 410/32
7,543,667 B2 * 6/2009 Hwang ..... H01M 8/04201 180/314
8,016,300 B2 * 9/2011 Cramer ..... B62B 5/049 137/899.3
8,146,761 B2 * 4/2012 Fawley ..... B65D 88/128 220/1.5
8,408,600 B2 * 4/2013 Kondo ..... B60K 15/07 280/834
9,499,047 B2 * 11/2016 Milton ..... F17C 5/06
9,752,726 B2 * 9/2017 Frenal ..... F17C 1/02
2003/0146214 A1 8/2003 Idoguchi
2007/0267370 A1 11/2007 Johnson
2008/0110784 A1 5/2008 Nowicki
2014/0290797 A1 * 10/2014 Kriese ..... F17C 13/084 141/99

FOREIGN PATENT DOCUMENTS

DE 3805497 C1 * 4/1989 ..... F17C 13/084
DE 10005846 A1 * 9/2001 ..... B65D 63/00
DE 102009036722 A1 * 3/2010 ..... F17C 13/083
EP 2 369 221 9/2011
EP 2682667 A2 * 1/2014 ..... F17C 13/084
EP 2682667 A3 * 3/2018
FR 843326 A * 6/1939 ..... B65D 71/00
FR 2036205 A5 * 12/1970 ..... F17C 13/084
FR 2505778 A1 * 11/1982 ..... B65B 27/04
FR 2510973 A2 * 2/1983 ..... B65B 27/04
GB 2007348 A * 5/1979 ..... F17C 13/084
GB 2 101 956 1/1983
GB 2101956 A * 1/1983 ..... B65B 27/04
WO WO-0218837 A1 * 3/2002 ..... F17C 13/084
WO WO 2008 081401 7/2008
WO WO 2012 071593 5/2012

OTHER PUBLICATIONS

International Search Report for corresponding PCT/FR2016/052004, dated Nov. 11, 2016.
International Search Report and Written Opinion for corresponding PCT/FR2016/052004, dated Feb. 8, 2016.

* cited by examiner

STORAGE BOX FOR BOTTLES OF PRESSURIZED FLUID AND ASSOCIATED STORAGE FRAME

CROSS REFERENCE TO RELATED APPLICATIONS

This application is a 371 of International Patent Application PCT/FR2016/052004, filed Aug. 2, 2016, which claims priority to French Patent Application FR 1558242, filed Sep. 4, 2015, the entire contents of which are incorporated herein by reference.

BACKGROUND

The invention relates to the field of the storage and transportation of cylinders (bottles) of pressurized fluid, notably pressurized gas, of composite construction.

In order to store and transport cylinders of pressurized fluid and notably pressurized gas, use is made, in a known way, of frames in which the cylinders are mounted horizontally or vertically. The cylinders are often arranged in said frames contiguously either side by side or in a staggered configuration, and held together transversely generally by straps, bars or metal bands.

More particularly, the cylinders are fixed at a first end by a fixed mechanical connection to part of the frame by means of a first plurality of retaining members, for example of screw/nut type, and are fixed at a second end by a fixed mechanical connection by means of a second plurality of retaining members for example of the screw/nut type.

This type of known storage configuration notably exhibits the disadvantage of adapting neither to the potential expansion of the cylinders as they are filled, nor to the geometry of the second end of the cylinders and the dimensions thereof that vary according to the manufacturer. Furthermore, certain configurations that propose storing cylinders contiguously damages the surface of the cylinders by abrasion, particularly the fibers of the cylinders when these cylinders are of composite construction.

SUMMARY

It is an object of the invention to overcome all or some of the aforementioned disadvantages.

One subject of the invention is a storage box for at least one cylinder of pressurized fluid, said storage box being intended to be mounted in a primary structure of a storage frame, and comprising at least one first retaining member configured to collaborate fixedly with a first end of a cylinder, and at least one second retaining member configured to collaborate with a second end of the cylinder, characterized in that the second retaining member is configured to maintain the position of the second end of the cylinder while at the same time exhibiting at least one determined degree of freedom.

The storage box according to the invention offers the advantage of being able to absorb the expansion of the volume of the cylinders notably as they are being filled, while at the same time immobilizing said cylinders in terms of rotation as a result of the firm fixing provided at the first end of each cylinder. Thus, the box according to the invention forms a unit assembly of cylinders which are fixed firmly at one end and floatingly at the other end. In other words, there is no firm mechanical connection at the second end of each cylinder, thus allowing the cylinders to move longitudinally in their region of retention.

In the present application what is referred to in a connection as a "degree of freedom" means the independent relative movements of one solid with respect to another which are permitted by this connection.

According to one feature of the invention, the storage box is configured to accept at least one cylinder arranged vertically or horizontally with respect to the ground.

According to one feature of the invention, the storage box comprises at least one first plate extending in a first direction, the first plate comprising at least one passage orifice configured to accept at least part of the first end of the cylinder in the mounted position.

Advantageously, the first direction is substantially perpendicular to the direction of mounting of the at least one cylinder when the cylinder is mounted in the box.

According to one feature of the invention, the storage box comprises several passage orifices equipping the first plate and configured to each accept the first end of each cylinder mounted or intended to be mounted in the storage box, the passage orifices being arranged on the first plate a regular or irregular distance apart. This makes it possible to avoid contact between the cylinders and wearing of these cylinders through rubbing.

According to one feature of the invention, the first plate is equipped with the first retaining member of the storage box, said first retaining member being configured to collaborate with a collar equipping the first end of the cylinder.

For preference, the at least one retaining member exhibits an internal screw thread configured to collaborate with an external screw thread formed on the collar of the first end of the cylinder, which allows the cylinder to be immobilized axially inside the storage box.

According to one feature of the invention, the storage box comprises at least one second plate extending in the first direction and positioned facing the first plate from a determined distance.

According to one feature of the invention, the determined distance between the first plate and the second plate is dependent on the dimensions of the cylinders to be mounted in the storage box and, in particular, is dependent on the length of the cylinders to be mounted in the storage box. For preference, the distance is comprised between 1000 mm and 2000 mm.

According to one feature of the invention, the storage box comprises a second retaining member corresponding to a passage orifice made in the second plate and configured to at least partially accept the second end of the cylinder.

According to one feature of the invention, the storage box comprises several retaining members corresponding to passage orifices made in the second plate and configured to each accept the second end of each cylinder mounted in the storage box, said retaining members being arranged a regular or irregular distance apart, which makes it possible to avoid contact between the cylinders and wearing thereof through rubbing.

According to one feature of the invention, each passage orifice of the plurality of the second plate is configured to collaborate, through having a complementary shape, with the second end of each cylinder, which makes it possible to index each cylinder and immobilize it in terms of rotation while at the same time maintaining the adaptation properties of the storage box.

For preference, each passage orifice has a multi-branch star shape.

According to one feature of the invention, the box comprises an immobilizing device configured to connect the first plate to the second plate while at the same time exhibiting at least one degree of freedom. For preference, this degree of freedom allows a degree of travel (limited adaptable positioning or clearance) in a direction parallel to the longitudinal axis of the cylinders. This degree of freedom (clearance) may be limited, for example, by a limit-stop(s) system.

Advantageously, the immobilizing device exhibits longitudinal elasticity of around 5% to 30% and preferably 10%; for an initial length of around 1000 mm to 2000 mm and, for preference, around 1500 mm; which represents an elongation comprised between around 5 to 60 cm and, for preference, 10 to 20 cm.

The immobilizing device makes it possible to absorb the possible elongation of the cylinders and therefore the potential movement of the first and second plates away from one another.

According to one feature of the invention, the immobilizing device comprises at least one screw/nut assembly extending in a direction substantially perpendicular to the direction in which the first plate and the second plate extend.

Advantageously, the screw/nut assembly passes through the first plate and the second plate.

According to another feature of the invention, the immobilizing device comprises at least two screw/nut assemblies spaced apart.

The invention also relates to a storage frame for cylinders, the storage frame comprising a primary structure and at least one storage box according to the invention, said at least one box being mounted in the primary structure.

In particular, the box is mounted removably in the primary structure.

According to one feature of the invention, the primary structure is defined by an all-welded assembly of metal uprights and bars.

According to one feature of the invention, the mounting of the cylinders in the box is performed independently of the frame.

According to one feature of the invention, the primary structure of the frame comprises at least one wedging element intended to accept the second end of at least one cylinder.

According to one feature of the invention, in the mounted position, the second end of each cylinder rests on a wedging element of the primary structure. Thus, part of the weight of the cylinders is also supported by the primary structure when the box is mounted in the structure of the frame and when at least one cylinder is mounted in said box.

According to one feature of the invention, the box is fixed to the primary structure by means of at least one fixed mechanical connection at the level of the second plate and by means of at least one mobile mechanical connection at the level of the first plate. Thus, as the cylinders lengthen, the first plate is left free to move axially because of the clearance allowed by the at least one mobile mechanical connection as far as a positioned end stop, for example defined by the collars mounted on the cylinders.

What is to be understood by a mobile mechanical connection in the present application is a mechanical connection of the bolt/nut type with a spacer or pin or spring-loaded system.

According to one feature of the invention, the at least one mechanical connection is configured to guide and fix the box on the primary structure at the level of the upper part of said box.

According to one feature of the invention, the storage box comprises a locking device comprising at least one locking member configured to pass through the structure of the box and, more preferably, the second end of the cylinder, when this is hollow.

According to one feature of the invention, the storage box comprises a plurality of cylinders.

Thus, there are as many retaining members equipping the first plate as there are cylinders provided for or mounted in the storage box and/or there are as many passage orifices made in the first plate as there are cylinders provided for or mounted in the storage box and/or there are as many retaining members equipping the second plate as there are cylinders provided for or mounted in the storage box.

According to one feature of the invention, each cylinder comprises a body, a first end and a second end opposite the first end. Advantageously, the first end is intended to be equipped with a cock or a valve.

According to one feature of the invention, the second end of each cylinder is configured to index and immobilize the position of the cylinder, when said cylinder is in the mounted position in the storage box.

For preference, the second end of each cylinder has a non-circular non-hemispherical polygonal cross section.

More preferably still, the second end has a cross section in the form of a multi-branch star, the branches being configured to index the cylinder and prevent the cylinder from rotating.

According to one feature of the invention, the length of the second end of the cylinder is greater than the longitudinal expansion of said cylinder, making it possible to prevent the cylinder from coming out of the passage orifice in the second plate.

According to another feature of the invention, the primary structure comprises at least one intermediate element or spacer piece configured to provide the interface between each cylinder and the primary structure. The intermediate element guarantees the absence of contact between the cylinder and the frame, for example metal-to-metal contact, which would cause premature wearing of the second end of the cylinder and notably damage to the, for example corrosion-resistant, coating applied to this region of the cylinder.

For preference, the at least one intermediate element is a ring or a gasket made of rubber or of elastomer. Advantageously, the at least one intermediate element has a hardness of between 70 Shore A and 60 Shore D, preferably between 80 and 90 Shore A.

According to one feature of the invention, the at least one intermediate element is removable with respect to the primary structure.

According to one feature of the invention, each at least one intermediate element is configured to accept and conform to the shape of the second end of each cylinder on an interior face.

According to one feature of the invention, each at least one intermediate element is configured to accept and conform to the shape of a housing formed on the primary structure on an exterior face.

BRIEF DESCRIPTION OF THE DRAWINGS

The invention will be better understood by virtue of the description which follows, which refers to some embodiments according to the present invention given by way of nonlimiting example and explained with reference to the attached schematic drawings in which.

DESCRIPTION OF PREFERRED EMBODIMENTS

Figure 1:
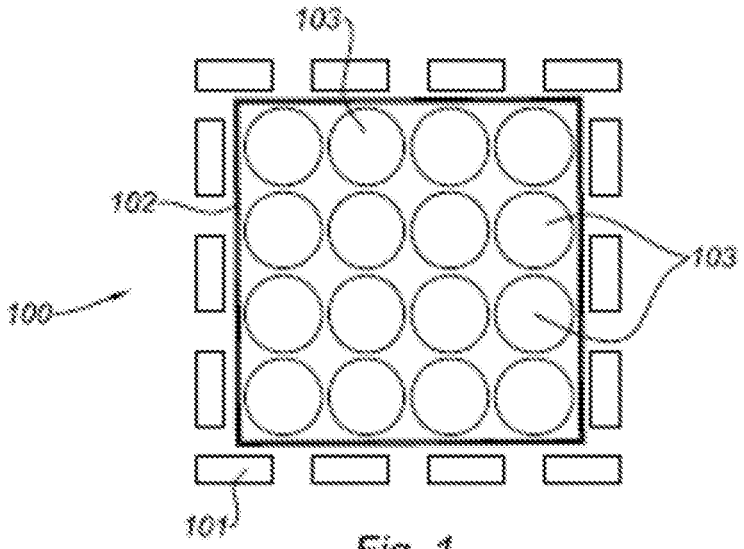
FIG. 1 is a schematic depiction of a first configuration of storage frame according to the invention.
Figure 2:
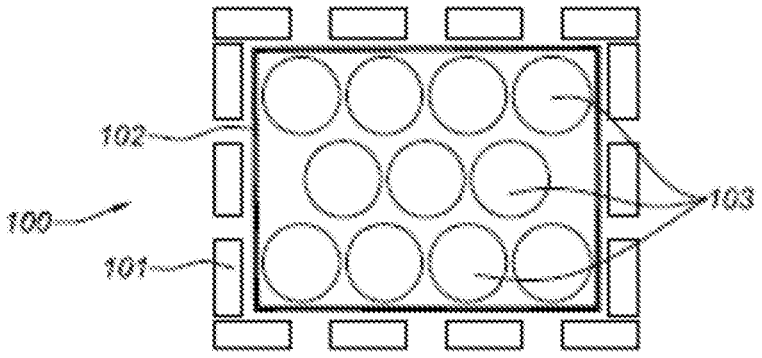
FIG. 2 is a schematic depiction of a second configuration of storage frame according to the invention
Figure 3:
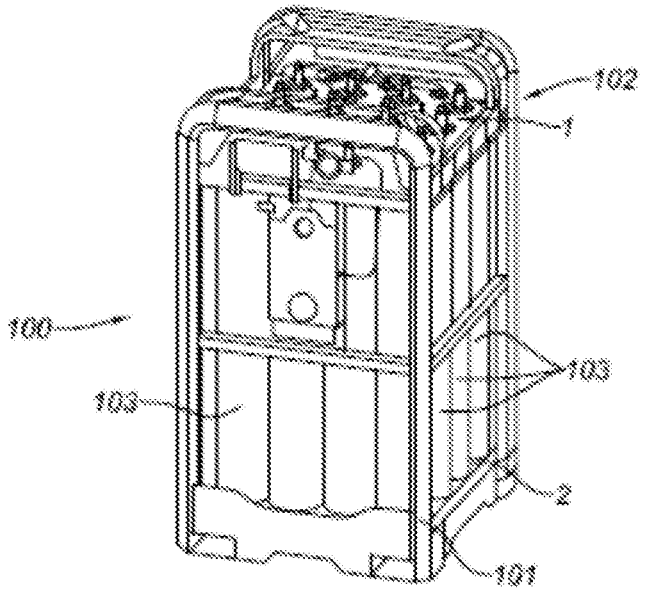
FIG. 3 is a perspective view of a storage frame according to a first embodiment of the invention.

The storage frame 100 according to the invention comprises a primary structure 101 in which there is arranged at least one storage box 102 according to the invention, as illustrated in FIGS. 1 to 3. The storage box 102 according to the invention 103 is intended to contain a plurality of cylinders 103 of pressurized fluid, and notably pressurized gas, as illustrated in FIG. 3.

As can be seen in the figures, the storage box 102 with its cylinders 102 thus forms a physical entity distinct (separable) from the storage frame 100.

The cylinders 103 are arranged in the storage box 102 vertically or horizontally with respect to the ground. Furthermore, as illustrated in FIG. 1, the arrangement of the cylinders 103 in the storage box 102 may be according to a first configuration illustrated in FIG. 1 or according to a second configuration illustrated in FIG. 2. In FIG. 1, the cylinders 103 are aligned in two directions and arranged without contact with one another. In FIG. 2, the cylinders 103 are aligned in one direction and arranged in a staggered configuration in a second direction.

The mounting of the cylinders 103 in the storage box 102 is performed independently of the storage frame 100 as described hereinafter with reference to FIGS. 9 to 14 according to a first embodiment or according to a second embodiment as depicted in FIGS. 19 to 23.

Figure 4:
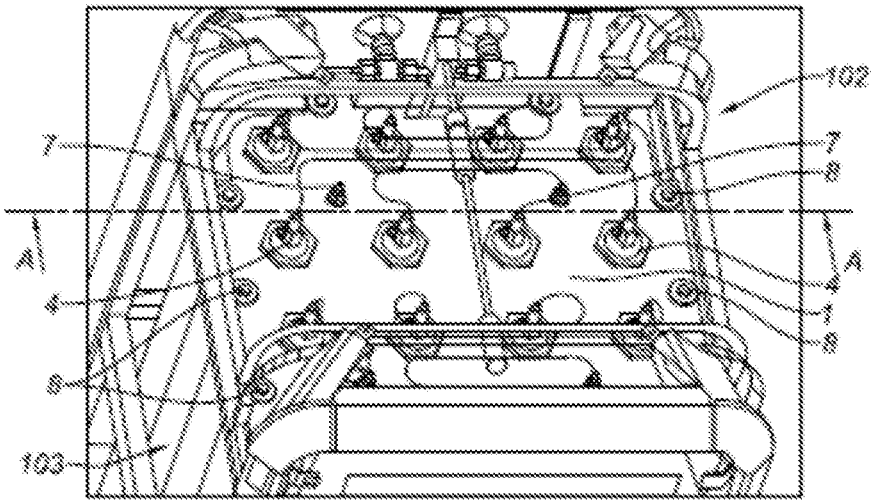
FIG. 4 is a perspective view from above of the storage frame depicted in FIG. 3.
Figure 5:
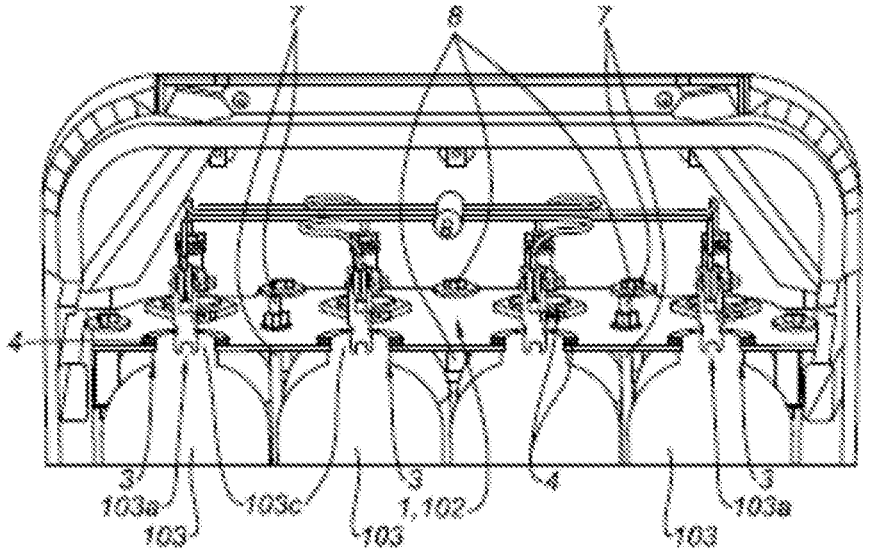
FIG. 5 is a view in part section on A-A of the storage frame depicted in FIG. 4.

The storage box 102 comprises at least one first plate 1 extending in a first direction substantially perpendicular to the direction of mounting of the cylinders 103, as illustrated in FIGS. 3, 4 and 5.

As illustrated in FIG. 5, the first plate 1 comprises a plurality of passage orifices 3 each configured to accept the first end 103*a* of each cylinder 103. More particularly, the first end 103*a* of each cylinder 103 is equipped with a collar 103*c* that passes through the passage orifice 3 and comprises a shoulder that comes into abutment against the first plate 1. Furthermore, the passage orifices 3 made in the first plate 1 are arranged regular distances apart.

In the example illustrated particularly in FIG. 5, the first plate 1 is equipped with the first plurality of retaining members 4 which are configured to each collaborate with the collar 103*c* equipping the first end 103*a* of each cylinder 103. For preference, each retaining member 4 exhibits an internal screw thread configured to collaborate with an external screw thread formed on the collar 103*c* of each cylinder 103.

Figure 7:
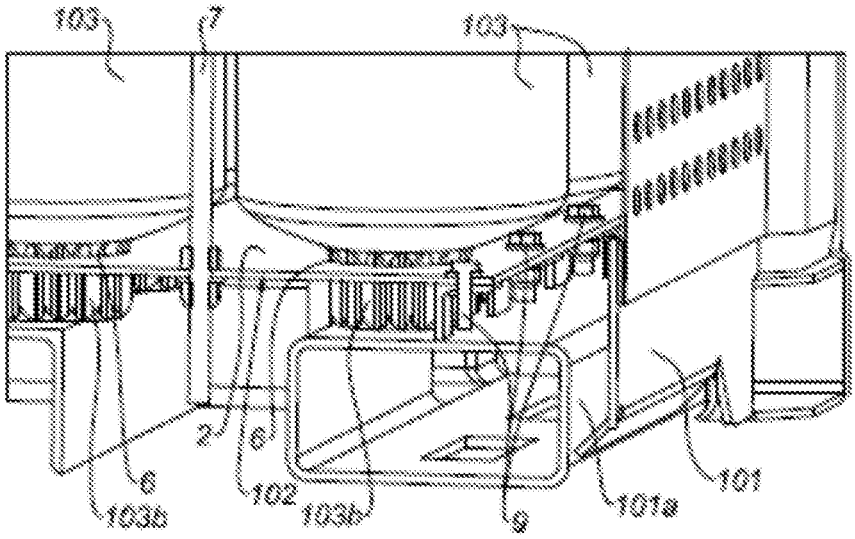
FIG. 7 is a detailed perspective view of the lower part of the storage frame according to a first embodiment of the invention.
Figure 8:
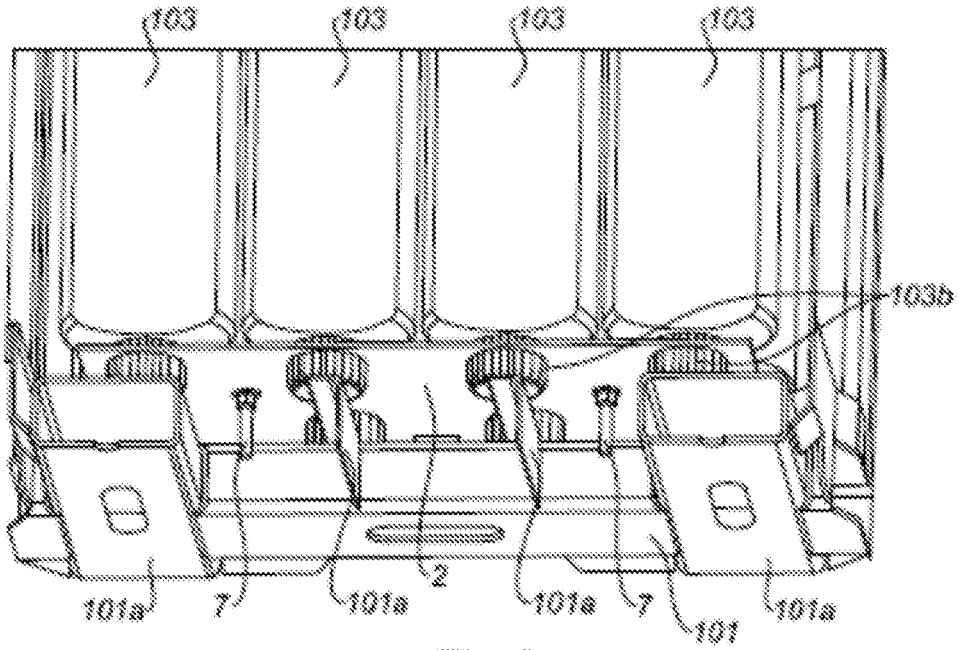
FIG. 8 is a perspective view of the lower part of the storage frame according to a first embodiment of the invention.
Figure 9:
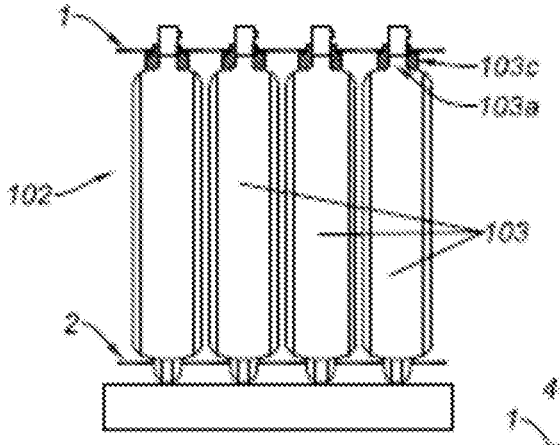
FIG. 9 is a schematic view depicting the mounting of a box according to the invention in a frame according to a first embodiment of the invention.

As illustrated in FIGS. 3, 7 and 8 in particular, the storage box 102 comprises at least one second plate 2 extending in the first direction and positioned facing the first plate 1 from a predetermined distance.

In the example illustrated in FIG. 8, the second plate 2 exhibits a plurality of passage orifices 6 acting as retaining members 6 for the second end 103*b* of each cylinder 103. The passage orifices 6 made in the second plate 2 are arranged a regular distance apart.

Each passage orifice 6 of the second plate 2 is configured to collaborate, through having a complementary shape, with the second end 103*b* of each cylinder 103. In the example illustrated in FIGS. 7 and 8, the second end 103*b* of each cylinder 103 is polygonal in shape, having a star-shaped cross section. The passage orifices 6 of the second plate 2 forming the retaining members 6 are configured to hold the second end 103*b* of each cylinder 103 while at the same time exhibiting at least one determined degree of freedom.

As illustrated, this degree of freedom is notably longitudinal, which means to say that the second end 103*b* of the cylinder 103 may have a limited clearance in the second plate 2 in the longitudinal direction of the cylinder.

Figure 6:
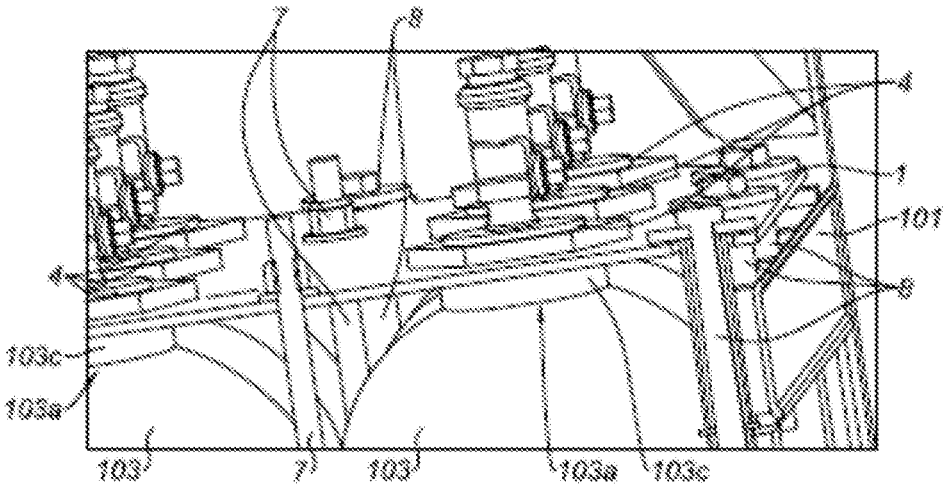
FIG. 6 is a detailed perspective view of the upper part of the storage frame according to a first embodiment of the invention.

As illustrated in FIGS. 5 to 7, the storage box 102 comprises an immobilizing device 7 configured to connect the first plate 1 to the second plate 2 while at the same time exhibiting at least one degree of freedom. The immobilizing device 7 comprises several screw/nut assemblies extending in a direction substantially perpendicular to the direction in which the first plate 1 and the second plate 2 extend. Each screw/nut assembly passes through the first plate 1 and the second plate 2.

Other equivalent immobilizing devices (studs, etc.) are conceivable.

According to the invention and as visible in FIG. 8, the primary structure 101 of the storage frame 100 comprises several wedging elements 101*a*. In the mounted position as illustrated in FIG. 8, the second end 103*b* of each cylinder 103 rests on a wedging element 101*a* of the primary structure 101.

As illustrated in FIG. 7, the storage box 102 is fixed to the primary structure 101 by means of fixed mechanical connections 9 at the level of the second plate 2 and by means of mobile mechanical connections 8 at the level of the first plate 1 as visible in FIGS. 3 to 7.

The mounting of a storage box 102 according to the invention in a storage frame 100 according to a first embodiment will now be described with reference to FIGS. 9 to 14.

The cylinders 103 are first of all mounted between a first plate 1 and a second plate 2. More specifically, the first end 103*a* of each cylinder 103 passes through a passage orifice 3 made in the first plate 1 and the second end 103*b* of each cylinder 103 passes through a passage orifice 6 made in the second plate 2 as visible in FIG. 9.

Figure 10:
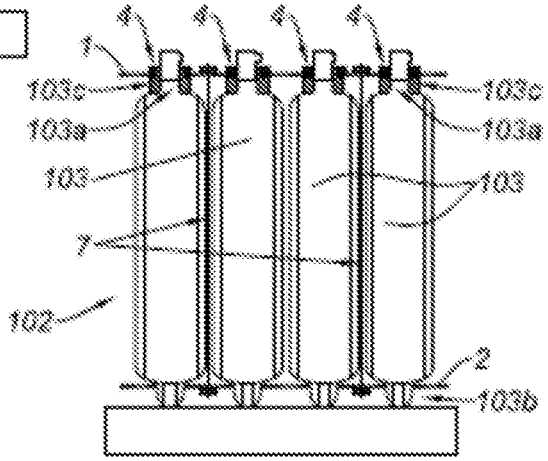
FIG. 10 is a schematic view depicting the mounting of a box according to the invention in a frame according to a first embodiment of the invention.

As illustrated in FIG. 10, the first end 103*a* of each cylinder 103 is fixed to the first plate 1 by means of retaining members 4. More particularly, each first end 103*a* of each cylinder 103 is equipped with a threaded collar 103*c* onto which a retaining member 4, for example a nut or a retaining ring, is screwed. Furthermore, the second end 103*b* of each cylinder 103 is retained through its collaboration, through having a complementary shape, with the passage orifice 6 made in the second plate 2. Each passage orifice 6 in the second plate 2 therefore forms a retaining member. A system of the pulley block type and a jig may advantageously be used to make it easier to mount the cylinders 103 inside the storage box 102.

In order to immobilize the storage box 102, an immobilizing device 7 is arranged between the first plate 1 and the second plate 2. More particularly, a plurality of screw/nut assemblies is installed in the storage box 102 as can notably be seen in FIG. 10, and allows the first plate 1 to be connected to the second plate 2.

Figure 11:
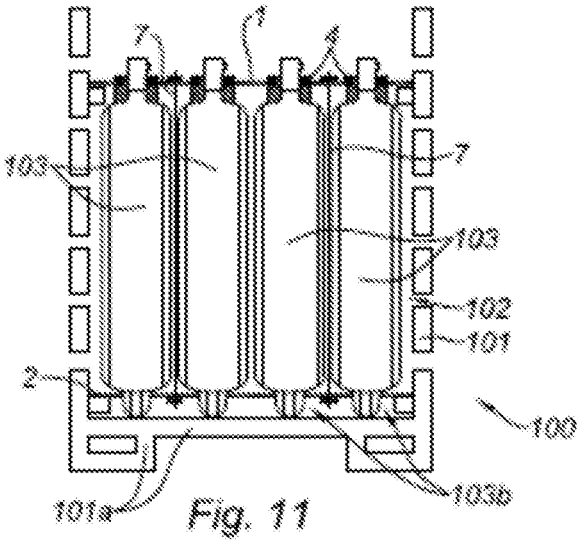
FIG. 11 is a schematic view depicting the mounting of a box according to the invention in a frame according to a first embodiment of the invention.

In FIG. 11, the storage box 102 is inserted into a primary structure 101 to form the storage frame 100. A lifting system of the pulley block or crane type may be used.

Figure 12:
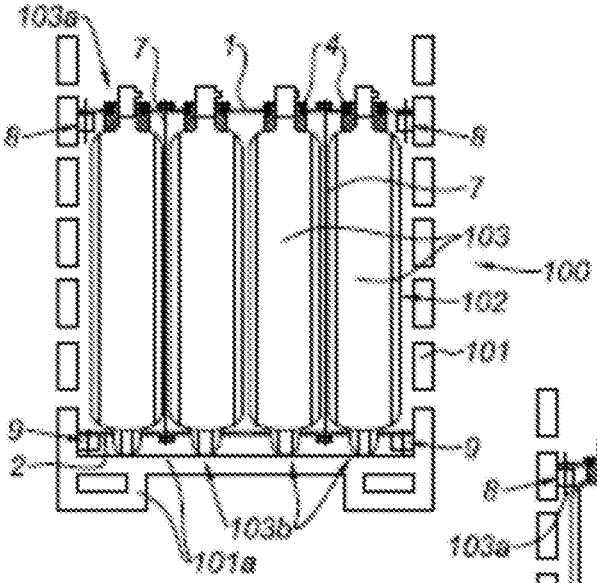
FIG. 12 is a schematic view depicting the mounting of a box according to the invention in a frame according to a first embodiment of the invention.

In FIG. 12, the storage box 102 is adjusted and secured inside the primary structure 101 of the storage frame 100 by means of mobile mechanical connections 8 perpendicular to the direction of the first plate, at the level of the first plate 1, and by means of fixed mechanical connections 9 at the level of the second plate 2.

The mechanical connections comprise for example screw and nut or screw and tapping or stud and nut and/or bolt systems or any other appropriate system that allows the storage box 102 to be secured inside the primary structure 101 of the frame.

For preference, the fixed mechanical connections 9 immobilize the second plate 2 on the primary structure in all three directions in space (fixed point with no degree of freedom). For example, several screws 9 pass through passages made in the second plate and fix this plate 2 to the primary structure 101. Note that this second plate 2 may comprise orifices (star-shaped or otherwise) that complement the exterior shape of the second end of the cylinders 103*b*, to immobilize same in terms of rotation.

The mobile mechanical connections 8 immobilize the first plate 1 on the primary structure 101 in two directions (immobilization in the plane of the first plate 1) while at the same time allowing the first plate 1 a limited travel in a direction perpendicular to the plane of the first plate 1. What that means to say is that the first plate 1 can move in a direction parallel to the longitudinal axis of the cylinders 103, notably to absorb longitudinal expansion thereof (the travel is limited vertically when the cylinders 103 are arranged oriented vertically in FIGS. 9 and 10 for example). This limited movement has an amplitude for example of 5 to 30 mm and notably of 20 mm.

This also makes it possible likewise to absorb variations in dimensions between the storage box 102 and the primary structure 101 of the frame (in order to adapt to suit the longitudinal dimensional tolerances and/or expansion tolerances).

Figure 13:
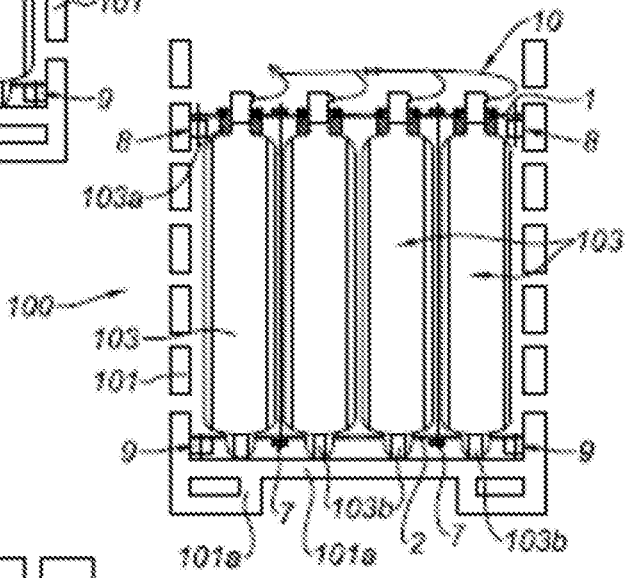
FIG. 13 is a schematic view depicting the mounting of a box according to the invention in a frame according to a first embodiment of the invention.

In FIG. 13, the connecting-up is carried out and the gas distribution systems 10 are installed, then the primary structure 101 is closed.

Figure 14:
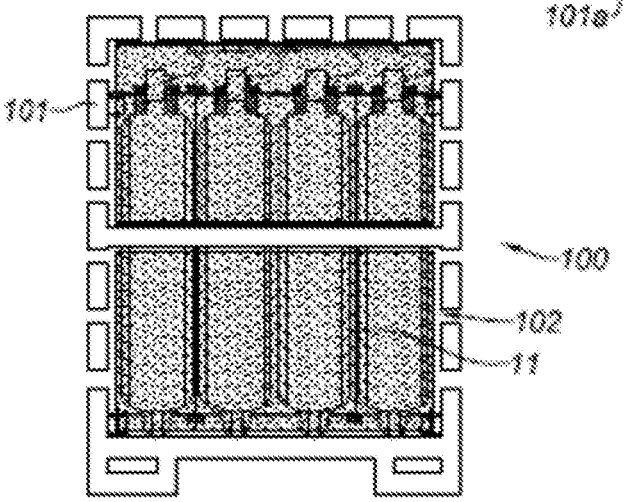
FIG. 14 is a schematic view depicting the mounting of a box according to the invention in a frame according to a first embodiment of the invention.

Finally, as illustrated in FIG. 14, equipment 11 (plates, reinforcers, user façade, etc.) is fitted on the lateral faces of the storage frame 100 formed. In the case of a storage frame 100 for storing cylinders 103 horizontally, the storage frame 100 is turned over on the ground onto its lower part in order to stand it upright.

The mounting of a storage box 102 according to the invention in a storage frame 100 according to a second embodiment will now be described with reference to FIGS. 19 to 23.

The second embodiment of the storage frame 100 according to the invention differs from the first embodiment in that the second plate 2 of the storage box 102 is omitted and replaced by a portion of the primary structure 101.

Figure 19:
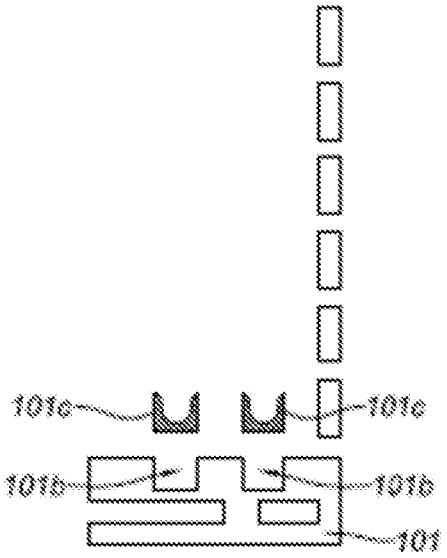
FIG. 19 is a schematic view depicting the mounting of a box according to the invention in a frame according to a second embodiment of the invention.

More specifically and as illustrated in FIG. 19, the primary structure 101 exhibits a plurality of housings 101*b* made in a portion of said primary structure 101. In a first mounting step, intermediate elements 101*c* or spacer pieces are positioned in said housings 101*b* so as to provide the interface between the cylinders 103 and the primary structure 101.

Figure 20:
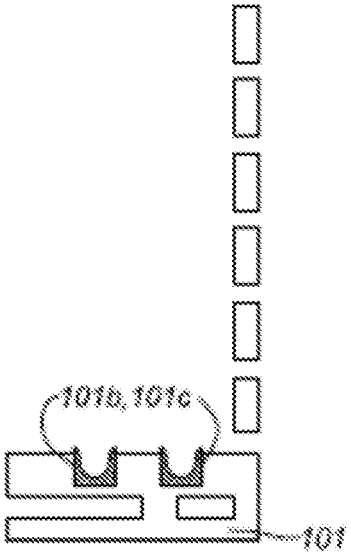
FIG. 20 is a schematic view depicting the mounting of a box according to the invention in a frame according to a second embodiment of the invention.

As can be seen in FIG. 20, each at least one intermediate element 101*c* is configured to accept and conform to the shape of each housing 101*b* formed on the primary structure 101, on an exterior face.

Figure 21:
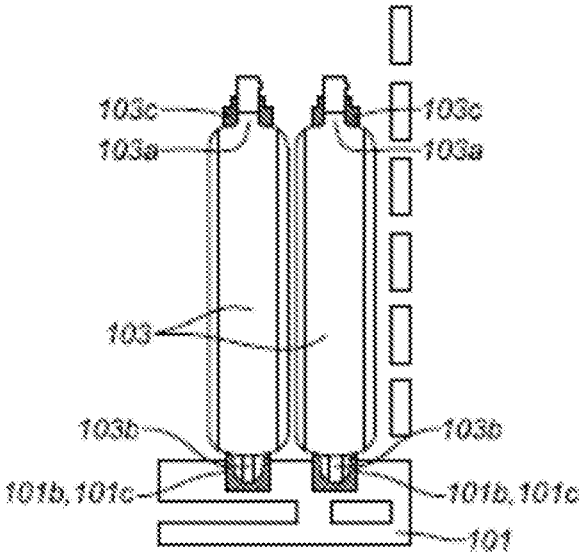
FIG. 21 is a schematic view depicting the mounting of a box according to the invention in a frame according to a second embodiment of the invention.
Figure 22:
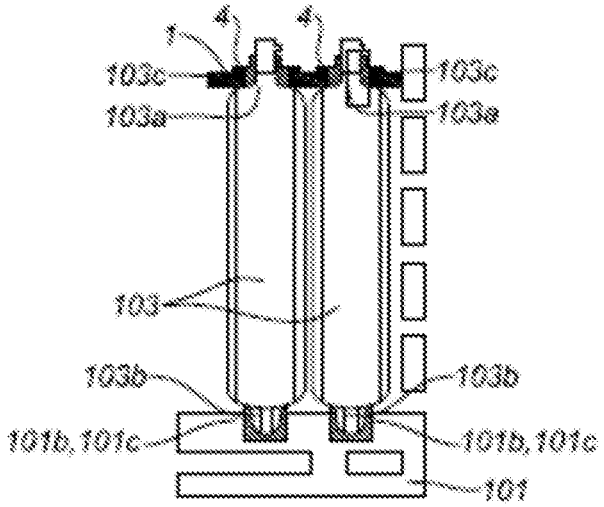
FIG. 22 is a schematic view depicting the mounting of a box according to the invention in a frame according to a second embodiment of the invention.

The cylinders 103 are then placed in each intermediate element 101*c* as visible in FIG. 21. Each intermediate element 101*c* is configured to accept and conform to the shape of the second end 103*b* of each cylinder 103 on an interior face.

Next, the first plate 1 is positioned at the level of the first end 103*a* of each cylinder 103.

Figure 23:
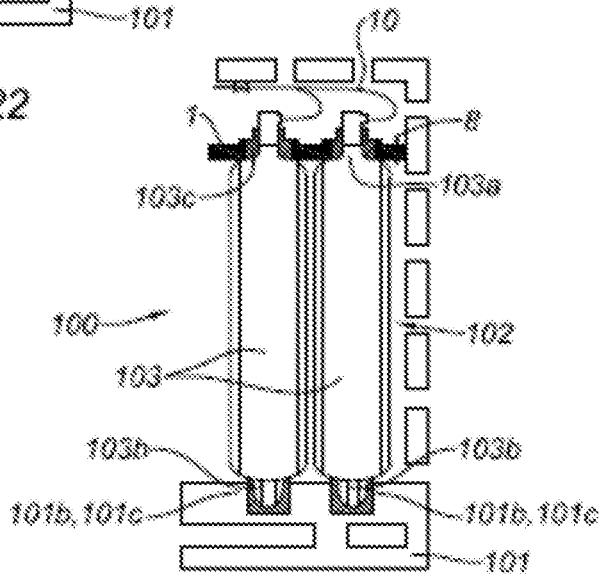
FIG. 23 is a schematic view depicting the mounting of a box according to the invention in a frame according to a second embodiment of the invention.

Finally, as illustrated in FIG. 23, connecting-up is performed, namely the connecting system and piping 10 with which the storage frame 100 is equipped are mounted, by cohabitation with the outlets of valves mounted at the outlet of the cylinders 103, and the gas distribution systems are installed, then the primary structure 101 is closed and equipment 11 (plates, reinforcers, user facades, etc.) is installed on the lateral faces of the storage frame 100 formed. In the case of a storage frame 100 for storing cylinders 103 horizontally, the storage frame 100 is turned over on the ground onto its lower part in order to stand it upright.

Figure 24:
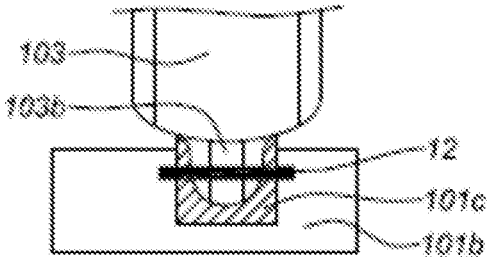
FIG. 24 is an alternative form of embodiment of the mounting depicted in FIGS. 19 to 23.

In an alternative form of embodiment depicted in FIG. 24, the storage frame 100 comprises a locking device comprising at least one locking member 12 configured to pass through the primary structure 101 and also the second end 103*b* of the cylinder 103 when this is hollow.

Figure 15:
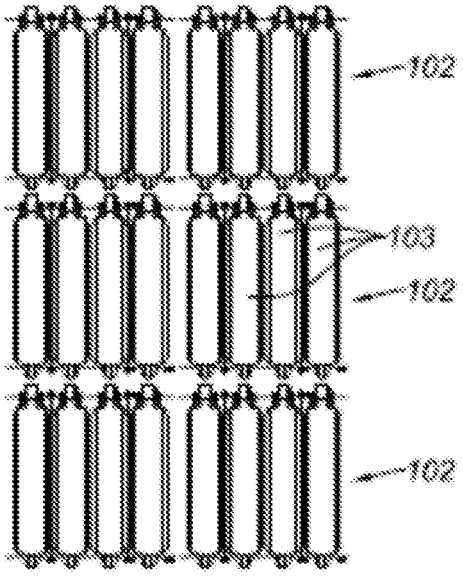
FIG. 15 is a schematic view depicting the mounting of several boxes according to the invention in a single frame whatever the embodiment of storage frame according to the invention.
Figure 16:
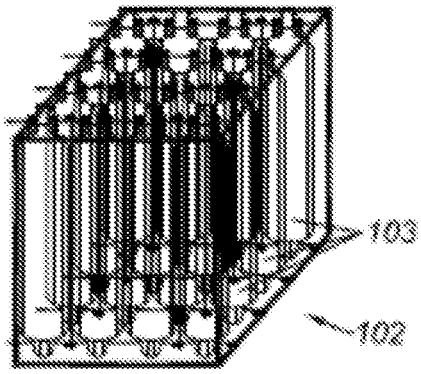
FIG. 16 is a schematic view depicting the mounting of several boxes according to the invention in a single frame whatever the embodiment of storage frame according to the invention.

When the storage frame 100 has capacity for several storage boxes 102, each storage box 102 is mounted independently as illustrated in FIGS. 15 and 16.

Figure 17:
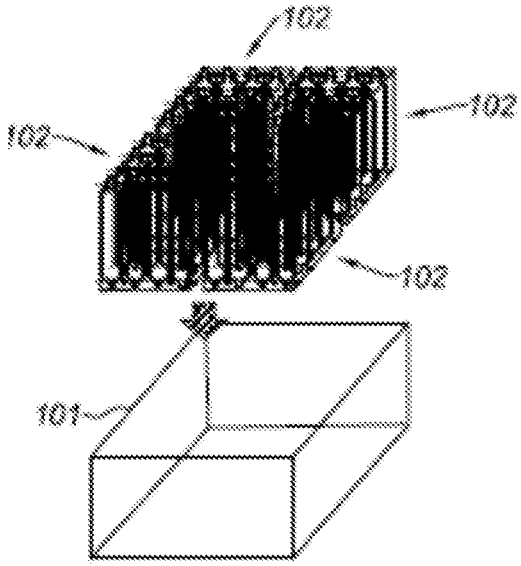
FIG. 17 is a schematic view depicting the mounting of several boxes according to the invention in a single frame whatever the embodiment of storage frame according to the invention.
Figure 18:
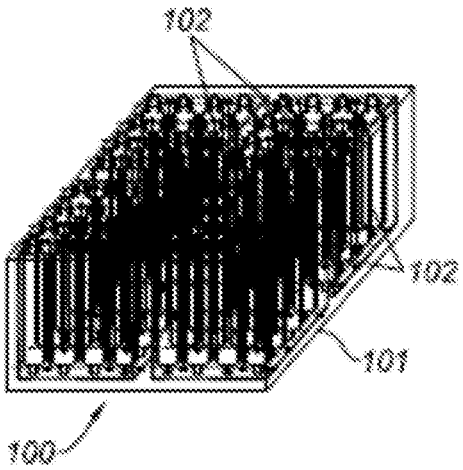
FIG. 18 is a schematic view depicting the mounting of several boxes according to the invention in a single frame whatever the embodiment of storage frame according to the invention.

The storage boxes 102 are then grouped together and assembled in the primary structure 101 which accommodates them as illustrated in FIGS. 17 and 18.

For a storage frame 100 that stores vertical cylinders, the storage frame 100 is positioned on the ground on its lower face. For a storage frame 100 for storing horizontal cylinders, the storage frame 100 is positioned on the ground on one of its lateral faces.

In the example illustrated in FIGS. 15 to 18, a storage box 102 contains from four to sixteen cylinders 103. A storage frame 100 designed according to the invention is constructed modularly with one to four storage boxes 102. For example, a storage frame 100 for storing sixteen cylinders 103 according to the invention can be designed on the basis of a storage box 102 for sixteen cylinders. A storage frame 102 for sixty-four cylinders 103 is designed on the basis of four storage boxes 102 for sixteen cylinders 103.

Of course, the invention is not restricted to the embodiments described and depicted in the attached figures. Modifications remain possible, notably regarding the makeup of the various elements or through the substitution of technical equivalents, without thereby departing from the scope of protection of the invention.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A storage frame for at least one cylinder of pressurized fluid, comprising:

a primary structure and at least one storage box, the storage box comprising at least one cylinder of pressurized fluid extending along a longitudinal axis between two ends, said storage box being mounted in the primary structure and comprising at least one first retaining member configured to collaborate fixedly with one end of the at least one cylinder and blocking the rotation of the at least one cylinder, and at least one second retaining member configured to collaborate with the other end of the at least one cylinder, the at least one second retaining member configured to maintain a position of the other end of the at least one cylinder while at the same time exhibiting at least one determined degree of freedom, and the storage box forming, in the primary structure, a unit assembly of at least one cylinder fixed firmly at one end and floatingly at the other end, wherein there is no firm mechanical connection at one end of each of the at least one cylinder so as to allow each of the at least one cylinder a longitudinal movement in a region of retention making it possible to absorb the expansion of the volume of the at least one cylinder as each is being filled.

2. The frame of claim 1, wherein the storage box comprises at least one first plate extending in a first direction, the first plate comprising at least one passage orifice configured to accept, in the mounted position, at least part of the first end of the at least one cylinder which collaborates with the first retaining member.

3. The frame of claim 2, wherein the storage box comprises several passage orifices equipping the first plate and configured to each accept the first end of each of the at least one cylinder mounted in the storage box, the passage orifices being arranged on the first plate a regular or irregular distance apart.

4. The frame of claim 2, wherein the first plate is equipped with the first retaining member of the storage box, said first retaining member being configured to collaborate with a collar equipping the first end of the at least one cylinder.

5. The frame of claim 4, wherein the at least one first retaining member exhibits an internal screw thread configured to collaborate with an external screw thread formed on the collar of the first end of the at least one cylinder.

6. The frame of claim 2, further comprising at least one second plate extending in the first direction and positioned facing the first plate from a determined distance.

7. The frame of claim 6, wherein the second retaining is configured to at least partially accept the second end of the at least one cylinder.

8. The frame of claim 6, further comprising several retaining members corresponding to passage orifices made in the second plate and configured to each accept the second end of each of the at least one cylinder mounted in the storage box, said retaining members being arranged a regular or irregular distance apart.

9. The frame of claim 8, wherein each passage orifice of the second plate is configured to collaborate, through having a complementary shape, with the second end of each of the at least one cylinder.

10. The frame of claim 6, further comprising an immobilizing device configured to connect the first plate to the second plate while at the same time exhibiting at least one degree of freedom.

11. The frame of claim 10, wherein the immobilizing device comprises at least one screw or nut assembly extending in a direction substantially perpendicular to the direction in which the first plate and the second plate extend.

12. The frame of claim 11, wherein the screw or nut assembly passes through the first plate and the second plate.

13. The frame of claim 6, wherein the storage box is fixed to the primary structure by means of at least one fixed mechanical connection at the level of the second plate and by means of at least one mobile mechanical connection at the level of the first plate.

14. The frame of claim 13, wherein the at least one fixed mechanical connection immobilizes the storage box on the primary structure in all three directions in space.

15. The frame of claim 13, wherein the at least one mobile mechanical connection immobilizes the storage box on the primary structure in the two directions of the plane of the first plate while at the same time allowing limited axial travel in the third direction in space which is parallel to the longitudinal axis of the at least one cylinder.

16. The frame of claim 6, wherein the primary structure of the frame comprises at least one wedging element intended to accept the second end of at least one cylinder so that, in the mounted position, the second end of each of the at least one cylinder rests on a wedging element of the primary structure.

* * * * *